US006276081B1

(12) United States Patent
Shedd

(10) Patent No.: US 6,276,081 B1
(45) Date of Patent: Aug. 21, 2001

(54) PLACARD SUPPORT FOR VEHICLE VISOR

(76) Inventor: John G Shedd, 10551 Catawba Way, Rancho Cordova, CA (US) 95670

( * ) Notice: Subject to any disclaimer, the term of this patent is extended or adjusted under 35 U.S.C. 154(b) by 0 days.

(21) Appl. No.: 09/619,356

(22) Filed: Jul. 19, 2000

(51) Int. Cl.[7] ..... G09F 21/04

(52) U.S. Cl. ..... 40/593; 116/309; 116/28 R; 40/643; 40/484

(58) Field of Search ..... 40/593, 482, 484, 40/492, 661.06, 661.07, 643, 644; 116/303, 309, 313, 319, 28 R

(56) References Cited

U.S. PATENT DOCUMENTS 937,264 * 10/1909 Philbrick ..... 40/484
2,025,151 * 12/1935 Brillinger ..... 116/303
2,610,604 * 9/1952 Edwards ..... 40/484
5,230,174 * 7/1993 Reed ..... 40/492
6,163,997 * 12/2000 Deralas ..... 40/745

* cited by examiner

*Primary Examiner*—Cassandra H. Davis
(74) *Attorney, Agent, or Firm*—Heisler & Associates

(57) ABSTRACT

A mounting apparatus for vehicle identification placards is provided that can be attached to the flat inner surface of a vehicle sun visor. The placard mount optionally includes a retainer body that is pivotally mounted to a base and provides a structure through which the placard is attached to the base. The pivotal mounting of the placard and placard retainer to the base allows the placard to be moved from a visible to a non-visible position simply by rotating the retaining body around the pivotal mount. To display the placard, the user simply lowers the sun visor which contains the mounting apparatus attached to a back side of the visor and then rotates the placard from its stored horizontal position downward to a vertical display position. In this position the placard is clearly visible from the exterior, such as for communicating to the authorities that the vehicle is properly parked in space, such as a handicapped space, where only authorized placard displaying vehicles should be parked.

9 Claims, 3 Drawing Sheets

10
18
20
16
22
24
52
34
22
26
30
12
28

28
20
16
26
10
12
34
22
24
22
52

PLACARD SUPPORT FOR VEHICLE VISOR

FIELD OF THE INVENTION

The present invention relates to an improvement in the methods used to display identification placards such as handicapped placards on the sun visor of a typical automobile. More specifically, this invention relates to a method of displaying such placards that allows them to be easily moved into a visible position for display purposes when parking the automobile when necessary and also to be moved and stored up out of view when not in use.

BACKGROUND OF THE INVENTION

In the past, people who were required to identify themselves and their automobiles in parking situations as being handicapped or as having special parking privileges have often used a hanging placard device to make such identifications. Such placards are made of a relatively thin plastic or cardboard-like material having the appropriate identification insignia printed on either side. These placards are generally about twice the size of an average playing card and are constructed with an integral hook-like apparatus built into the upper portion of the body of the placard. The hook is used to hang the placard over the horizontally extending mirror post that is commonly used to mount the interior rear view mirror to the inside of a vehicle windshield. This placement of the placard on the rearview mirror post positions it in a manner that is highly visible from the exterior of the vehicle allowing parking enforcement workers to easily identify it as belonging to a specific authorized class of vehicle operators.

One problem with this method of vehicle identification is that the positioning of the placard on the mirror post can interfere with a driver's line of sight during vehicle operation. This occurs because, in order for the placard to be clearly visible from the exterior of the vehicle, its body must hang down near the center of the vehicle's windshield. The placement of the placard in this position creates a blind spot in a driver's field of vision. This blind spot can be extremely dangerous to the safe operation of a vehicle as objects such as pedestrians and small vehicles can be hidden from the driver which creates especially dangerous conditions in right turn situations.

The most common way to deal with this problem is to remove the placard during vehicle operation. While the placard's removal is an effective way to resolve the problem of the blind spot, it creates additional problems of its own. The first of these is that an operator that is in a hurry very often forgets to properly position the placard prior to leaving his vehicle in a restricted parking spot. This can lead to unnecessary and expensive parking tickets. Additionally, the removal of the placard during vehicle operation can, and very often does, result in its loss. Again, this can lead to expensive and unnecessary parking tickets and the expense and aggravation of replacing the placard.

From the forgoing discussion it can be seen that it would be advantageous to provide a method of displaying parking identification placards which allows them to be easily recognized from the exterior of the vehicle. Additionally, it would be advantageous to provide such a method that would allow the placard to be easily stored out of sight during vehicle operation in a manner which allows it to be quickly and easily deployed when parking in restricted spots.

SUMMARY OF THE INVENTION

It is the primary objective of the present invention to provide a method by which a vehicle identification placard can be displayed in a manner which allows it to be easily recognized from the exterior of a parked vehicle.

It is an additional objective of the present invention to provide such a method of displaying a placard which will allow for its easy identification from the exterior of the vehicle in a manner that will not interfere with the driver's field of vision during vehicle operation.

It is a further objective of the present invention to provide such a method of displaying an identification placard which will allow for its quick and easy storage out of the driver's line of sight during vehicle operation.

It is a still further objective of the present invention to employ such a method of displaying a placard which provides a means of storage that ensures it will always be in a place that it can easily be retrieved and displayed in a restricted parking situation.

These objectives are accomplished by the use of a placard mount that can be attached to the flat inner surface of a driver's side vehicle sun visor. The placard mount is equipped with a base which is attached to the visor, such as by the use of a plurality of hook and loop strips (i.e. Velcro™ or other similar attachment device or devices).

A retaining body is pivotally mounted to the base and provides the point at which a placard is attached to the present invention by the use of a pair of attachment clips that grasp and hold the placard within the retaining body. The pivotal mounting of the placard retainer to the base is preferably accomplished by the use of a screw and collar attachment assembly which allows the retainer to rotate independently with reference to the position of the base. Therefore, the pivotal nature of the attachment of the retaining body to the base allows the placard to be moved from a visible to a non-visible position simply by rotating the retaining body around the pivotal mount.

Thus, when a vehicle operator wishes to employ the present invention to display his vehicle's status as being eligible to park in certain restricted parking spaces, he simply lowers the driver's side sun visor which contains the invention attached to its back side. Once the visor is in the proper position, he then rotates the placard from its stored horizontal position downward to its vertical display position. In this position the placard is clearly visible from the exterior which conveys to the appropriate individuals that the vehicle is properly parked in the restricted space.

Conversely, when the vehicle operator leaves the restricted parking space, he only has to rotate the placard back to its stored horizontal position on the back of the driver's side sun visor and the visor can then be rotated up out of the way or left down to perform its intended function. In this stored position, the placard is kept neatly out of the way and clear of the driver's field of vision. Additionally, the present invention keeps the placard in a place that it is always easily located and accessible, especially for the handicapped.

For a better understanding of the present invention reference should be made to the drawings and the description in which there are illustrated and described preferred embodiments of the present invention.

DESCRIPTION OF THE PREFERRED EMBODIMENT

Figures 1, 2:
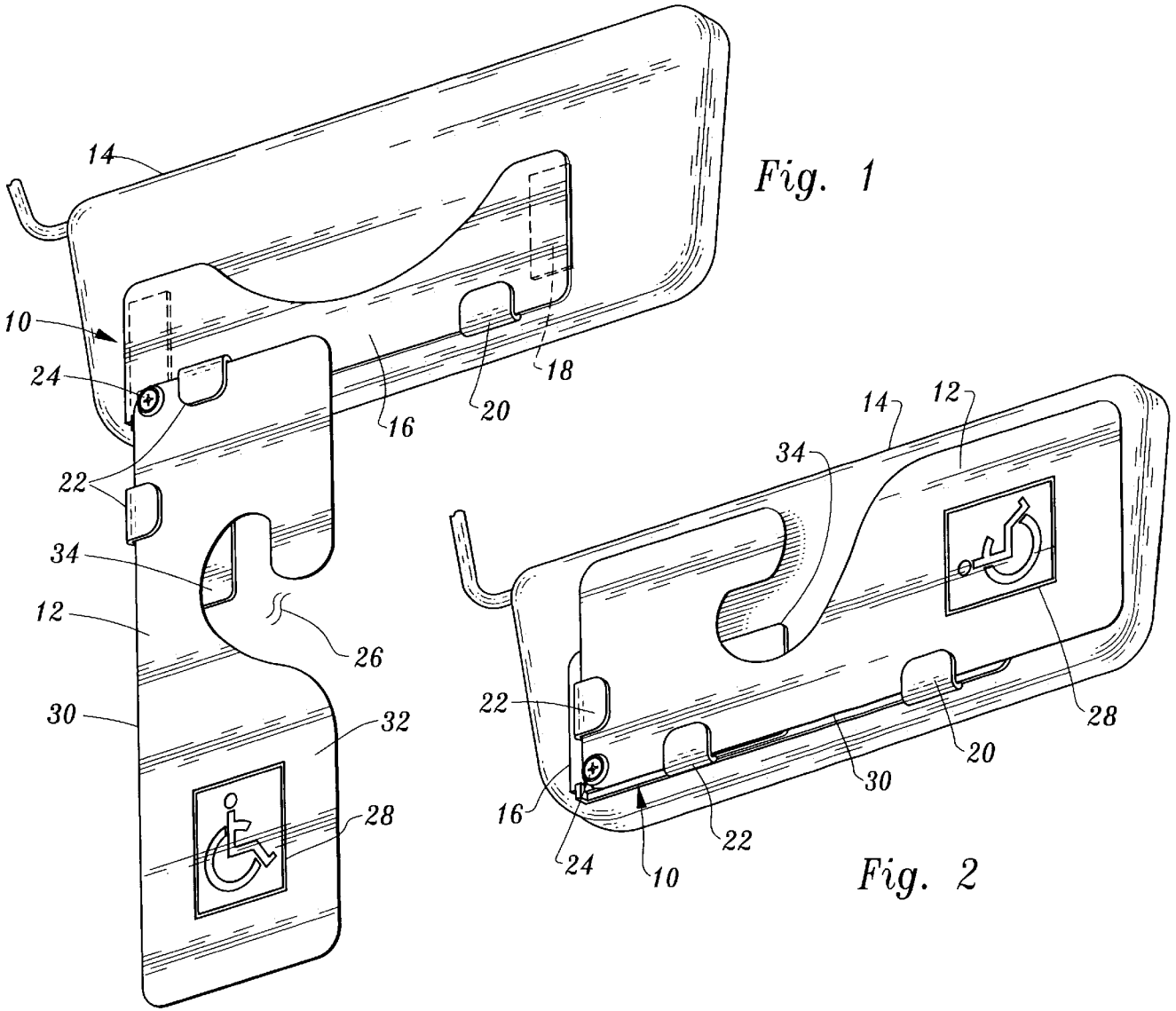
FIG. 1 is a perspective view of the present invention which illustrates the manner in which the base is attached to the back side of a typical automobile sun visor and the manner in which the placard can be rotated down to place it in a highly visible position from the vehicle's exterior.
FIG. 2 is a perspective view of the present invention illustrating its orientation when the placard is placed in its horizontal stored position on the rear surface of the vehicle's sun visor.

Referring now to the drawings, and more specifically to FIGS. 1 and 2, the placard support 10 includes a base 16 which is the component of the invention to which all others are attached. The base 16 is preferably generally rectangular in shape and is designed to be attached to the rear side of a vehicle visor 14. This attachment is accomplished through the use of a plurality of attachment apparatuses 18 that are fixed to the back surface of the invention's base 16. The attachment apparatuses 18 are most preferably constructed of hook and loop fastener tape adhesively held to the base 16, but almost any type of fastener may be used. Additionally, the attachment apparatuses 18 located on the rear side of the base 16 also have corresponding complemental attachment apparatuses 18 located on the surface of the vehicle visor 14, such as with an adhesive, and it is the connection of these corresponding complemental pieces that holds the base 16, and therefore the support 10, to the vehicle's visor 14. Preferably, two patches of the hook and loop attachment apparatus 18 are provided along side edges of the base 16 horizontally spaced from each other.

The base 16 also provides the point at which the placard retainer body 34 is pivotally mounted. The placard retainer body 34 is the component of the invention which preferably holds the identification placard 12 in the desired orientation on the vehicle visor 14. Alternatively, the retainer body 34 can be omitted and the placard 12 itself pivotally attached to the base 16 directly. The pivotal attachment of the retainer body 34 (or the placard 12 directly) to the base 16 is preferably accomplished by the use of the pivotal attachment screw assembly 24. The attachment is made at the lower left corner (when the present invention is in place on the rear side of a vehicle visor 14) of the base 16 by the pivotal attachment of the placard 12 (and optionally the retainer body 34) at their upper left corners when the are in their vertical or display position. This method of attachment allows the placard 12 to be pivoted from its horizontal or stored position to its vertical or display position while remaining attached to the base 16.

The retainer body 34 also contains a pair of placard retainer clips 22 which are relatively small tab-like extensions of the main portion of the retainer body 34 which are folded back over the upper surface of the retainer 34. This folding leaves a space between the placard retainer clips 22 and the surface of the retainer body 34 into which the placard mount edge 30 fits, which is on the opposite side of the placard 12 to the hanging hook 26 of the placard 12. This manner of placing the placard 12 within the retainer body 34 allows the identification symbol 28 contained on the lower portion of the placard 12 to be displayed in a highly visible orientation.

The base 16 of the present invention also contains a placard storage clip 20 which is an apparatus that is similar in construction and purpose as the placard retainer clips 22 on the retainer body 34. The placard storage clip 20 includes a rest extending away from the base 16 and is folded back to define a lip configured as a tab-like extension of the base 16 which is located on its lower edge in relation to the vehicle visor 14 and on the side of the base 16 that is opposite the pivotal attachment screw assembly 24. The purpose of the placard storage clip 20 is to provide a point of securement for the placard 12 when it is in its horizontal or stored position. Thus, when the vehicle operator wishes to store the placard 12 in a non-visible orientation, he simply pivots it up until its placard mount edge 30 is parallel to the lower edge of the base 16. At this point, he then slips the placard mount edge 30 into the gap between the placard storage clip 20 and the surface of the base 16. This secures the placard 12 in this position so that it will remain in place regardless of the orientation of the vehicle visor 14 and allows it to be easily returned to the display position as needed.

Figure 3:
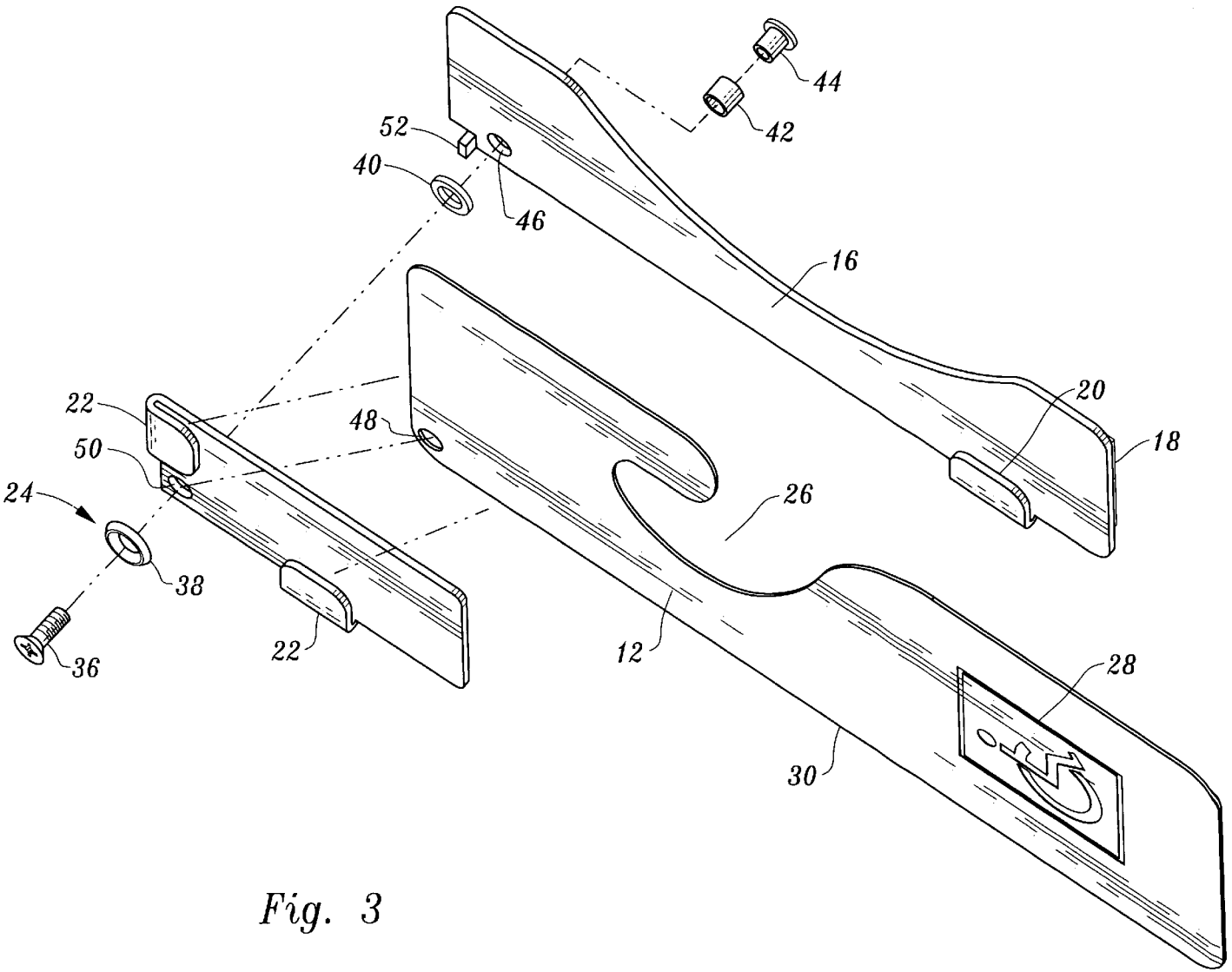
FIG. 3 is an exploded perspective view of the present invention illustrating the manner of construction of its major components and the manner in which they fit together to form the invention.

The manner in which the individual components of the present invention and the identification placard 12 fit together is further illustrated in FIG. 3. This figure details the fact that the invention's base 16 has a body hole 46 located in its lower left corner and the placard retainer body 34 also has a retainer body hole 50 in a corresponding location on its lower left corner. Additionally, the placard 12 itself is also equipped with a placard hole 48 in a corresponding location. In the assembly process, the body, placard, and optionally retainer body holes, 46, 48, 50, are lined up with one another by placing the placard 12 within the retainer clips in the retainer body 34 and slipping the placard 12 and retainer body 34 assembly into the proper position on the surface of the base 16. Once this has been accomplished, the attachment is secured by passing the pivotal attachment screw assembly 24 through the lined up holes 46, 48, 50 of the base 16, retainer body 34, and placard 12.

The pivoting ability provided to the present invention by the pivotal attachment screw assembly 24 is a function of its design. The pivotal attachment screw assembly 24 is primarily made up of the attachment screw 36 and the screw receptor 44. In the assembly of the invention, the attachment screw 36 initially is passed through the front surface of the placard 12. The attachment screw 36 is isolated from the placard 12 by the use of the countersunk washer 38 which keeps the head of the attachment screw 36 from damaging the placard 12 and placard hole 48 which is important because of the pivotal forces imparted to this area through the pivoting of moving the placard 12 between its stored and displayed orientations.

After passing through the placard hole 48, the attachment screw then passes through the retainer body hole 50 located in the lower left corner of the retainer body 34 and then passes through a spacing washer 40. In conjunction with this, the screw receptor 44 located behind the base 16 is equipped with an extending and internally threaded shoulder which passes from behind the base 16 through the body hole 46. The shoulder of the screw receptor 44 is the component into which the attachment screw is threaded to complete the attachment of the invention's components.

Additionally, there is provided a slip collar 42 which closely yet rotationally fits over the shoulder of the screw receptor 44. This arrangement of the collar 42 and the screw receptor 44 allows each of them to rotate independently of one another which is important to the freely pivoting nature of the present invention. This occurs because the outside diameter of the slip collar 42 is just slightly smaller than the inside diameter of the base hole 46 which isolates the base 16 from the rest of the attachment screw assembly 24, and therefore from the placard 12 and placard retainer body 34. This means that the placard 12 and placard retaining body 34 may be freely rotated around the attachment screw assembly 24 while the base 16 remains solidly attached to the visor 14.

Figures 4, 5:
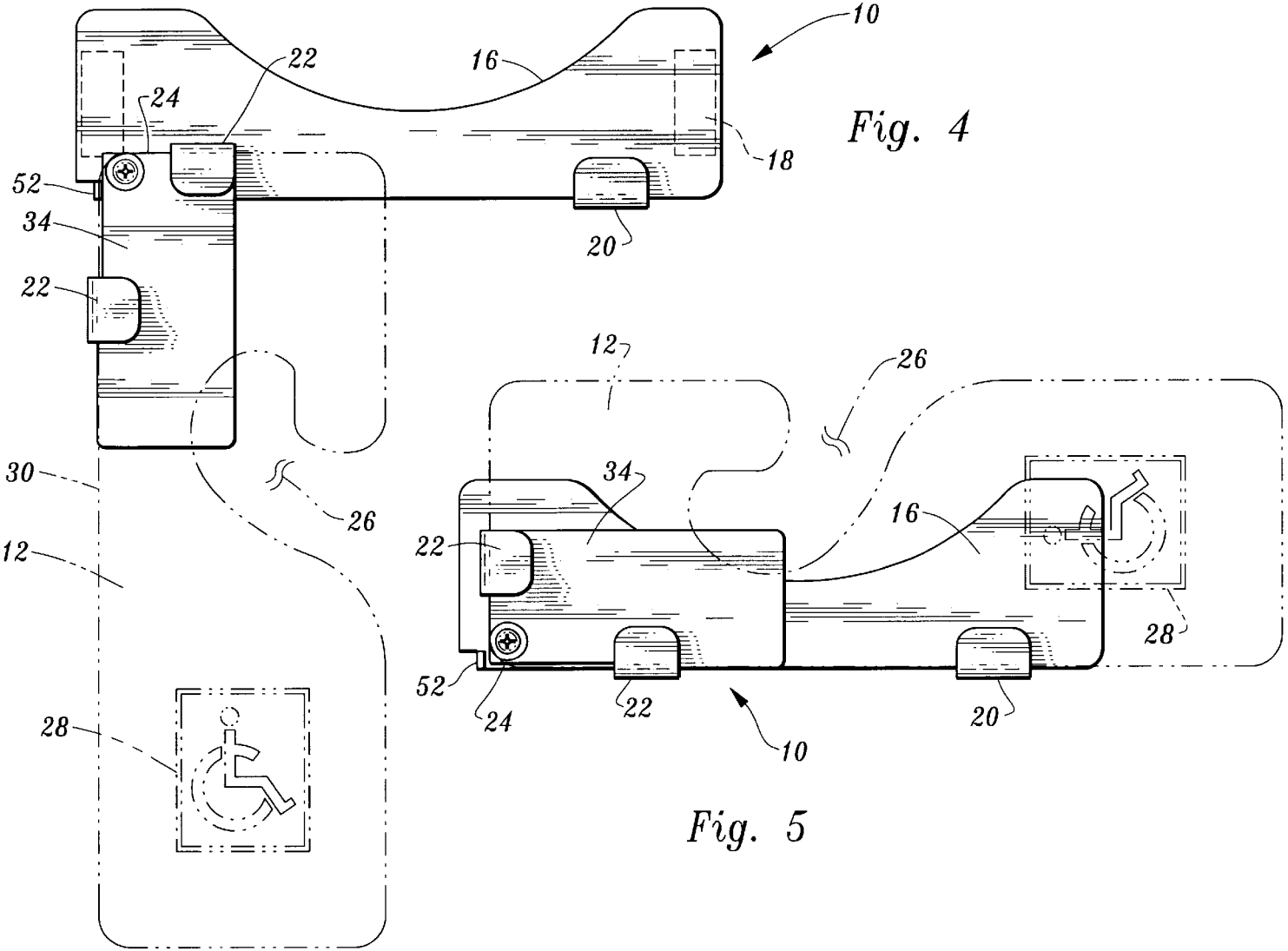
FIG. 4 is a front elevation view of the present invention illustrating the manner by which the placard is held in its display position by the vertically oriented placard retainer component, the placard itself shown in phantom.
FIG. 5 is a front elevation view of the present invention illustrating the manner by which the placard is held in its stored position by the horizontally oriented placard retainer component, the placard itself shown in phantom.

Finally, the orientation of the retainer body 34 and its related components to the base 16 of the present invention are further detailed in FIGS. 4 and 5. These figures illustrate the manner in which the placard 12 is held within the retainer body 34 by the use of the combination of the two placard retainer clips 22 located on the two adjoining surfaces of the rectangular surface of the retainer body 34 that surround the position of the pivotal attachment screw assembly 24 and by the use of the pivotal attachment screw assembly 24 itself. This method of placard 12 attachment ensures that the placard 12 is securely but pivotally coupled to the base 16 of the support 10 in a manner that allows for its pivotal rotation around the pivotal attachment screw assembly 24.

In addition, FIGS. 4 and 5 also illustrate the positioning of the rotation stop tab 52 on the lower left corner of the base 16 (also, see FIG. 3). The rotation stop tab 52 is a relatively small right angled tab-like protrusion of the base 16 just to the left and below the location of the pivotal attachment screw assembly 24 and the center of the invention's rotation. This positioning of the rotating tab stop 52 causes it to come into contact with the placard mount edge 30 when the placard 12 has been rotated down into its vertical position for display purposes. This contact causes the rotation of the placard 12 to stop which leaves it hanging in a perfectly vertical position in relation to the horizontal mounting of the invention's base 16. Conversely, the positioning of the rotating tab stop 52 does not interfere with the rotation of the placard 12 in an upward manner which allows it to be easily returned to the horizontal position for storage where it can be held in place by the use of the placard storage clip 20 located at the far end of the base 16.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. A placard support for attachment to a visor of a vehicle said placard support comprising:

a base section, for attachment to said visor of a vehicle said base section having a top and bottom edge, a left and a right edge and a front and a rear surface;

a placard retainer body having a top and a bottom edge, a left and a right edge and a front and rear surface; and a pivotal connection between said base section and said placard retainer body;

wherein said placard retainer body further comprises at least one placard retainer clip extending upward and over a portion of said front surface of said placard retainer body; and wherein said base section further comprises a placard storage clip extending upward over a portion of said front surface of said base section.

2. The placard support of claim 1 wherein said base section further comprises a rotation stop tab extending perpendicularly from said front surface of said base section.

3. The placard support of claim 2 wherein said pivotal connection comprises a fastener with a collar section.

4. The placard support of claim 3 wherein the rear surface of said base section is attachable to the visor with a hook and loop attachment.

5. The placard support of claim 4 further comprising a placard connected to said placard retainer body by said fastener and said at least one placard retainer clip on said front surface of said placard retainer body.

6. A placard support for attachment of a placard to a vehicle visor, said placard support comprising in combination:

a base attachable to said vehicle visor;

a pivot assembly coupled to said base and coupleable to the placard in a manner which allows pivoting between said base and the placard;

wherein said base includes a placard storage rest, said placard storage rest extending away from a surface of said base toward the placard when the placard is pivoted to a location adjacent said rest; and wherein said rest includes a lip extending away from an edge of said rest most distant from said base, said lip at least partially overlying a portion of said base with a gap between said lip and said base, said gap at least as wide as a thickness of the placard, such that the placard can be located between said lip and said base while abutting said rest.

7. A placard support for attachment of a placard to a vehicle visor, said placard support comprising in combination:

a base attachable to said vehicle visor;

a pivot assembly coupled to said base and coupleable to the placard in a manner which allows pivoting between said base and the placard;

wherein the placard is coupleable to a retainer, said retainer coupled to said pivot assembly, said retainer providing at least a portion of a coupling between the placard and said pivot assembly; and wherein said retainer includes at least one clip for support of the placard adjacent said retainer, a placard hole formable in the placard and alignable with a hole in said retainer, with said pivot assembly coupleable to both said retainer and the placard through said placard hole and said hole in said retainer.

8. A placard support for attachment to a visor of a vehicle said placard support comprising:

a base section, for attachment to the visor of a vehicle said base section having a top and bottom edge, a left and a right edge and a front and a rear surface;

a placard retainer body having a top and a bottom edge, a left and a right edge and a front and rear surface;

a pivotal connection between said placard retainer body and said base section;

a means of limiting the pivotal travel of said placard retainer body on said base section;

a means of connecting a placard to said placard retainer body;

wherein said means of connecting said placard to said placard retainer body is at least one placard retainer clip extending upward and over a portion of said front surface of said placard retainer body;

wherein said means of limiting the pivotal travel of said placard retainer body is a rotation stop tab extending perpendicularly from said front surface of said base section; and wherein said base section further comprises a retainer clip extending upward over a portion of said front surface of said base section.

9. The placard support of claim 8 wherein the rear surface of said base section is attachable to the visor with a hook and loop attachment.

* * * * *